US005412862A

United States Patent [19]

Comerci et al.

[11] Patent Number: 5,412,862

[45] Date of Patent: May 9, 1995

[54] APPLICATOR TOOL FOR ELECTRICAL CONNECTORS

[75] Inventors: Joseph D. Comerci, Elmhurst; Robert DeRoss, Naperville; Frederick J. Gierut, Glenview, all of Ill.

[73] Assignee: Molex Incorporated, Lisle, Ill.

[21] Appl. No.: 120,877

[22] Filed: Sep. 13, 1993

[51] Int. Cl.[6] ..... H01R 43/042

[52] U.S. Cl. ..... 29/751; 29/753; 29/758

[58] Field of Search ..... 29/33 M, 566.4, 749, 29/750–753, 758, 747; 7/107; 72/382, 384, 404, 410; 81/418, 421, 427

[56] References Cited

U.S. PATENT DOCUMENTS

| | | | |
|---|---|---|---|
| 2,616,316 | 11/1952 | Dupre | 81/427 X |
| 2,892,368 | 6/1959 | Demler | 72/404 |
| 3,432,906 | 3/1969 | McNamara | 29/747 |
| 3,710,610 | 1/1973 | McCaughey | 81/421 X |
| 4,005,518 | 2/1977 | Bakermans | 29/749 X |
| 4,091,531 | 5/1978 | Grubb et al. | 29/749 |
| 4,245,387 | 1/1981 | Reidt | 29/749 |
| 4,386,461 | 6/1983 | Plummer | 29/758 X |
| 4,389,769 | 6/1983 | Casey | 29/753 X |
| 4,393,580 | 7/1983 | Hall, Jr. | 29/749 |
| 4,467,516 | 8/1984 | John et al. | 29/566.4 |
| 4,928,379 | 5/1990 | Paquin et al. | 29/566.3 |
| 5,152,051 | 10/1992 | Folk et al. | 29/749 |

FOREIGN PATENT DOCUMENTS

| | | | |
|---|---|---|---|
| 0139229 | 9/1984 | European Pat. Off. | 29/753 |
| 3512157 | 10/1986 | Germany | 29/750 |

*Primary Examiner*—Peter Dungba Vo
*Attorney, Agent, or Firm*—Stephen Z. Weiss

[57] ABSTRACT

An applicator tool is provided for applying an electrical connector having a plurality of insulation piercing terminals onto a multi-conductor flat cable. The tool includes a frame having a press ram drivable through a working stroke toward and away from an anvil for supporting the connector. A fixed connector-positioning peg projects from the anvil and is adapted for abuttingly engaging one side of the connector. A spring-loaded yieldable peg projects from the anvil and is adapted for yielding to a retracted condition to facilitate positioning the connector between the pegs.

8 Claims, 3 Drawing Sheets

APPLICATOR TOOL FOR ELECTRICAL CONNECTORS

FIELD OF THE INVENTION

This invention generally relates to the art of tools for terminating conductors of an electrical cable and, particularly, to an applicator tool for applying an electrical connector having a plurality of insulation piercing terminals onto a multi-conductor cable such as a flat cable.

BACKGROUND OF THE INVENTION

There are a wide variety of applicator tools, such as cable terminating presses, for terminating electrical connectors to multi-conductor cables. Many such tools are hand tools for field use. These tools are used to perform operations ranging from simply crimping a terminal onto the end of a conductor wire to mass termination of a plurality of insulation piercing terminals in a connector to the conductors of a multi-conductor flat cable. Of course, the latter applications require considerable terminating forces.

One application area for such tools is in conjunction with convenience outlet assemblies for electrical wiring in certain buildings. Specifically, in frame structures, such as houses, electrical wiring is located behind wall panels, such as dry wall panels. Conventionally, the wiring is deployed prior to mounting the wall panels to the framing studs. Wall or outlet boxes are secured to the studs by nails or screws at predetermined locations prior to mounting the dry wall panels, with the positions of the boxes being marked and holes being cut in the panels. Thereafter, outlets, switches and other components are attached to the wiring and positioned within the outlet boxes, and face plates then are assembled to the front of the boxes.

Multifunctional convenience outlet assemblies for so-called intelligent wiring systems presently are being proposed. An intelligent wiring system may include both power conductors and data or signal conductors, for instance. Wiring for such systems has been provided by a hybrid ribbon or flat cable suitable for use in the intelligent wiring system.

It has become conventional for convenience outlet assemblies deployed with intelligent wiring systems to include a mounting bracket secured to a framing stud. A cable tap assembly is attachable to the flat ribbon cable. The cable tap assembly is mountable at the rear of a mounting box which is part of or separate from the mounting bracket. The cable tap assembly includes a plurality of insulation piercing terminals and a clamp, such as a plate, for clamping the flat ribbon cable and forcing the cable into insulation piercing termination with the terminals. An example of such a cable tap assembly is shown in application Ser. No. 082,216, filed Jun. 24, 1993, which is assigned to the assignee of this invention and which is incorporated herein by reference.

Hand operated tools are presently used for terminating the conductors of the hybrid ribbon cable to the insulation piercing terminals on the cable tap assembly. An example of such a tool is shown in U.S. Pat. No. 5,152,051 to Folk et al, dated Oct. 6, 1992. This patent addresses some of the problems in applying cable tap assemblies to hybrid ribbon cables, such as the need to maneuver in close quarters, in applying full support and backup for the terminals and in applying sufficient pressure to effect the desired termination without undue tool deflection.

However, problems still continue to present themselves in this area of terminating cable tap assemblies to flat cable such as the hybrid ribbon cable in intelligent wiring systems. The problems continue to revolve around the relative massiveness and awkward nature of the cable tap assemblies, particularly in close quarters. It simply is very difficult to precisely position the assemblies within the tool or press. This invention is directed to solving further problems in applicator tools of the character described and to satisfying the continuing need for an improved cable terminating press.

SUMMARY OF THE INVENTION

An object, therefore, of the invention is to provide a new and improved cable terminating press or applicator tool for terminating an electrical connector to a multi-conductor cable, such as an electrical connector having a plurality of insulation piercing terminals onto a multi-conductor flat cable. However, it should be understood that the concepts of the invention are not limited to the particular application.

In the exemplary embodiment of the invention, the applicator tool includes a frame having a press ram drivable through a working stroke toward and away from an anvil means which supports the connector. A connector positioning means are provided on the anvil means and include a fixed member and a yieldable member in spaced relationship to position the connector therebetween. The fixed member is adapted for abuttingly engaging one side of the connector, and the yieldable member is adapted for yielding to a retracted condition to facilitate positioning the connector between the members.

As disclosed herein, the anvil means is a generally flat platform and the press ram includes a press plate generally parallel to the platform, whereby the plate and platform define jaws of the applicator tool. At least a pair of spaced spring-loaded pins project from the press plate for engaging and stabilizing the connector. The fixed member and the yieldable member on the anvil means comprise pegs projecting from the flat platform. The yieldable peg is spring-loaded for yielding against a spring means and for automatically returning to a projecting connector-engaging condition. A rounded plate projects radially from the yieldable peg to provide an anti-snag means alongside the retractable peg.

At least one of the flat platform which defines the anvil means and the press plate on the press ram include holes or recess means to provide access therethrough by a hand tool to securing means on the connector. In other words, cable tap assemblies as described in the "Background" above include bolts for holding the assembly together after termination. Preferably, these bolts are tightened while the cable tap assembly is in the terminating tool.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
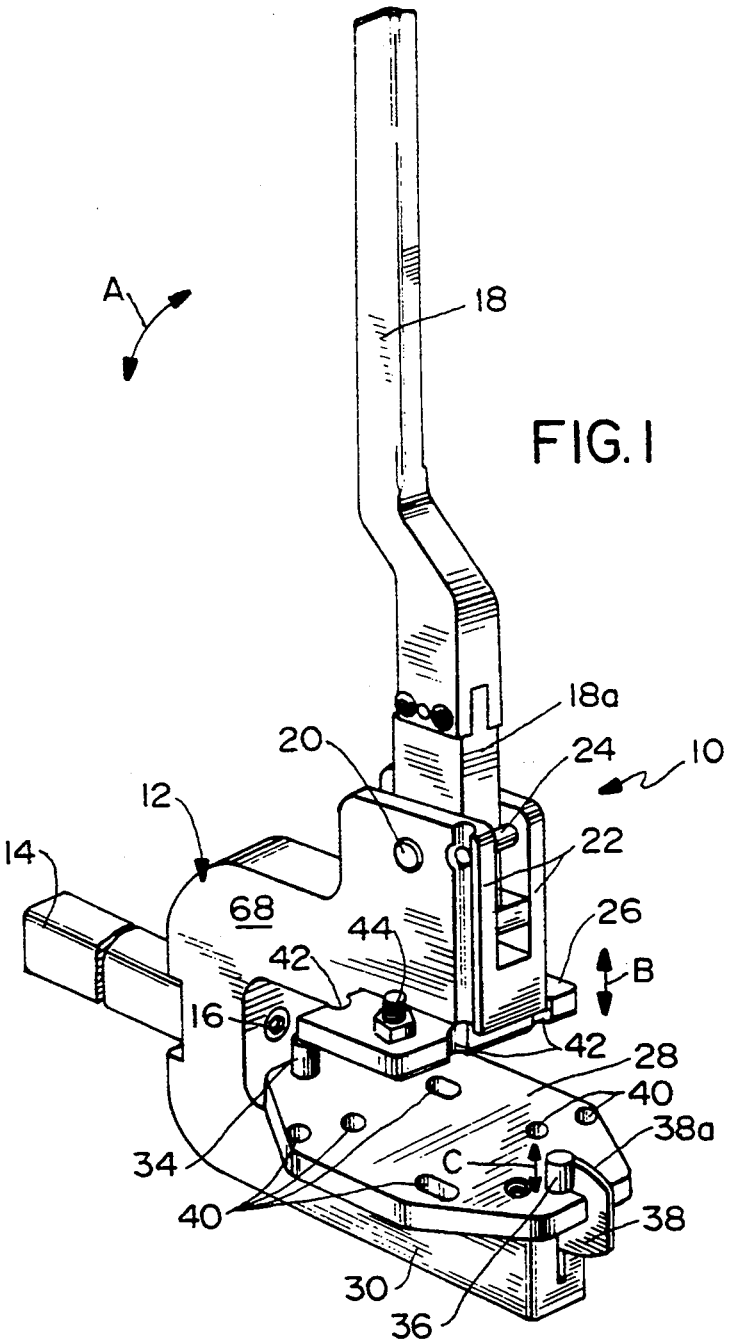
FIG. 1 is a top/front perspective view of the applicator tool of the invention with a portion of the frame cut away.
Figure 2:
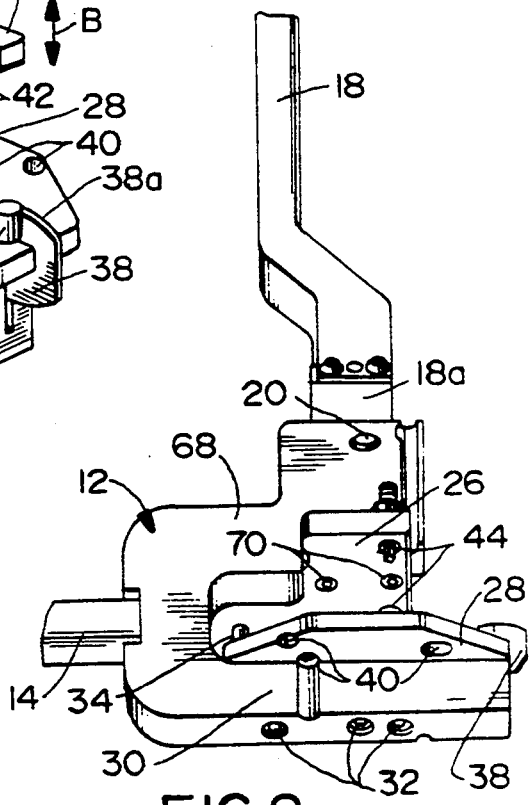
FIG. 2 is a bottom/side perspective view of the tool.

Referring to the drawings in greater detail, and first to FIGS. 1 and 2, the invention is embodied in an applicator tool in the form of a cable terminating press, generally designated 10. The tool includes a generally U-shaped frame, generally designated 12, to which a horizontal handle 14 is fixed by a securing bolt 16 (FIG. 1). A two-part handle 18 is pivotally mounted on the frame by means of a pivot pin 20. Handle 18 is pivotable about pin 20 toward and away from fixed handle 14 in the direction of double-headed arrow "A" (FIG. 1). A fulcrum part 18*a* of handle 18 is sandwiched between a pair of ears 22 of the frame, and a stop pin 24 extends between the ears and defines an upper-limit position of pivotal handle 18.

Figure 7:
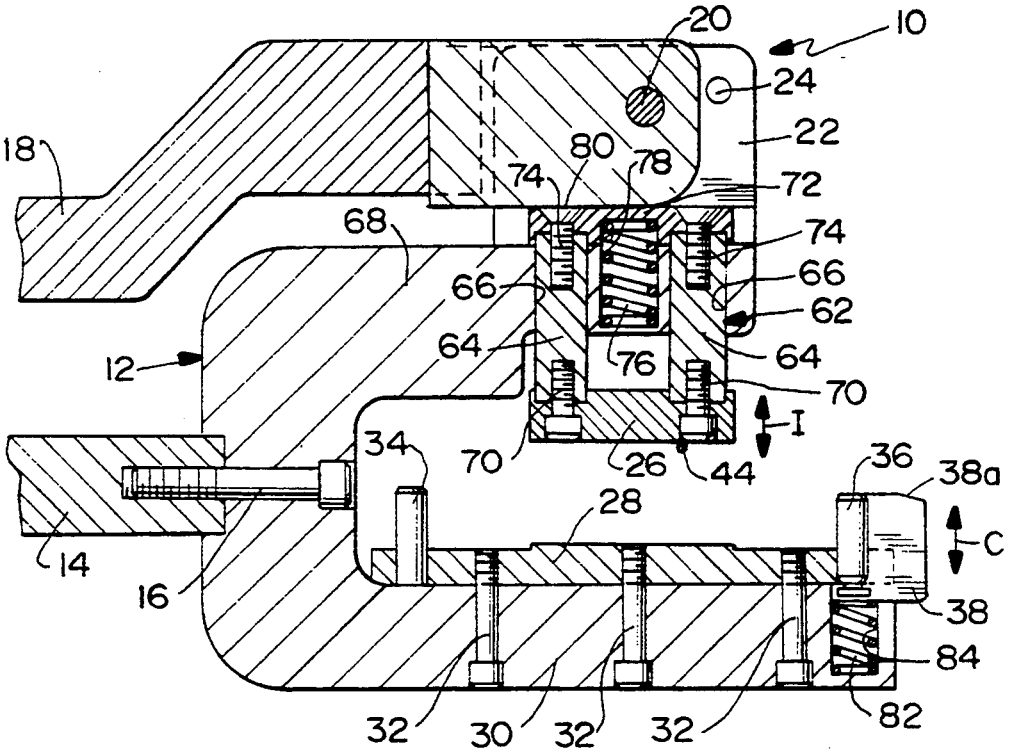
FIG. 7 is a fragmented vertical section taken generally along line 7—7 of FIG. 3, but with the press ram fully actuated and with no connector positioned therein.
Figure 8:
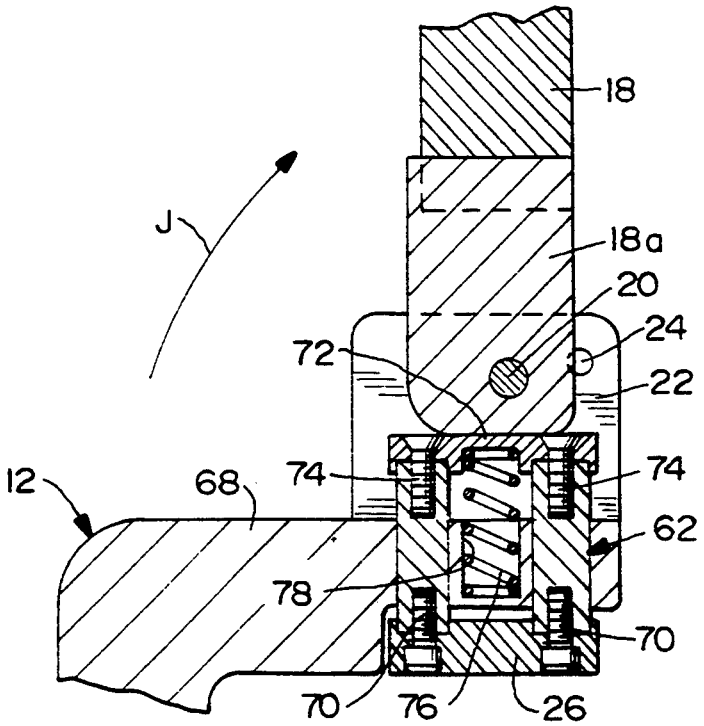
FIG. 8 is a section similar to the top portion of FIG. 7, with the press ram in elevated condition.

Tool 10 includes a press ram 62, as shown in detail in FIGS. 7 and 8, which includes a press plate 26 drivable by handle 18 through a working stroke as indicated by double-headed arrow "B" in FIG. 1. The press plate is movable toward and away from an anvil means in the form of a flat platform 28 which positions and supports the electrical connector described hereinafter. As seen in FIG. 2, anvil platform 28 is secured to a lower arm 30 of frame 12 by a plurality of securing bolts 32. In essence, plate 26 and platform 28 define opposing jaws of tool 10, with the plate defining a movable jaw and the platform defining a fixed jaw.

Referring particularly to FIG. 1, one feature of the invention is the provision of connector positioning means on anvil platform 28 for positioning and supporting the connector thereon, and particularly for facilitating mounting the connector in position on the platform. More particularly, the connector positioning means include a fixed member in the form of a peg 34 projecting from platform 28 in a direction toward press plate 26. The positioning means further include a yieldable member in the form of a second peg 36 spaced from fixed peg 34. Yieldable peg 36 is retractable into and out of anvil platform 28 in the direction of double-headed arrow "C". The yieldable peg has an anti-snagging cam plate 38 projecting radially outwardly from one side of the peg. The cam plate has a rounded upper edge 38*a* which is flush with the top of the yieldable peg.

Still referring to FIGS. 1 and 2, anvil platform 28 has a plurality of apertures 40 therethrough, and press plate 26 has a plurality of recesses 42 in the edges thereof. The precise location of these apertures and/or recesses are determined by the precise connector being terminated by tool 10. Some connectors, such as cable tap assemblies for convenience outlets, include securing means such as screws or bolts for tightening the assembly together once in terminated condition. It would be desirable to provide means to allow such tightening while the connector still is in terminated position within the tool. Therefore, holes 40 in anvil platform 28 and recesses 42 in press plate 26 provide access means for a tool, such as a screwdriver or an allen wrench, to the securing means on the connector while the connector still is positioned in the tool. Of course, the precise location of the apertures and/or recesses depends on the precise location of the securing means on the connector which is being terminated.

While still referring to FIGS. 1 and 2, a pair of spring-loaded pins 44 project from press plate 26 toward anvil platform 28 for engaging and stabilizing a connector positioned between the press plate and the anvil platform. In essence, these spring-loaded pins balance the connector against the relatively large surface area of anvil platform 28 prior to termination.

Figure 3:
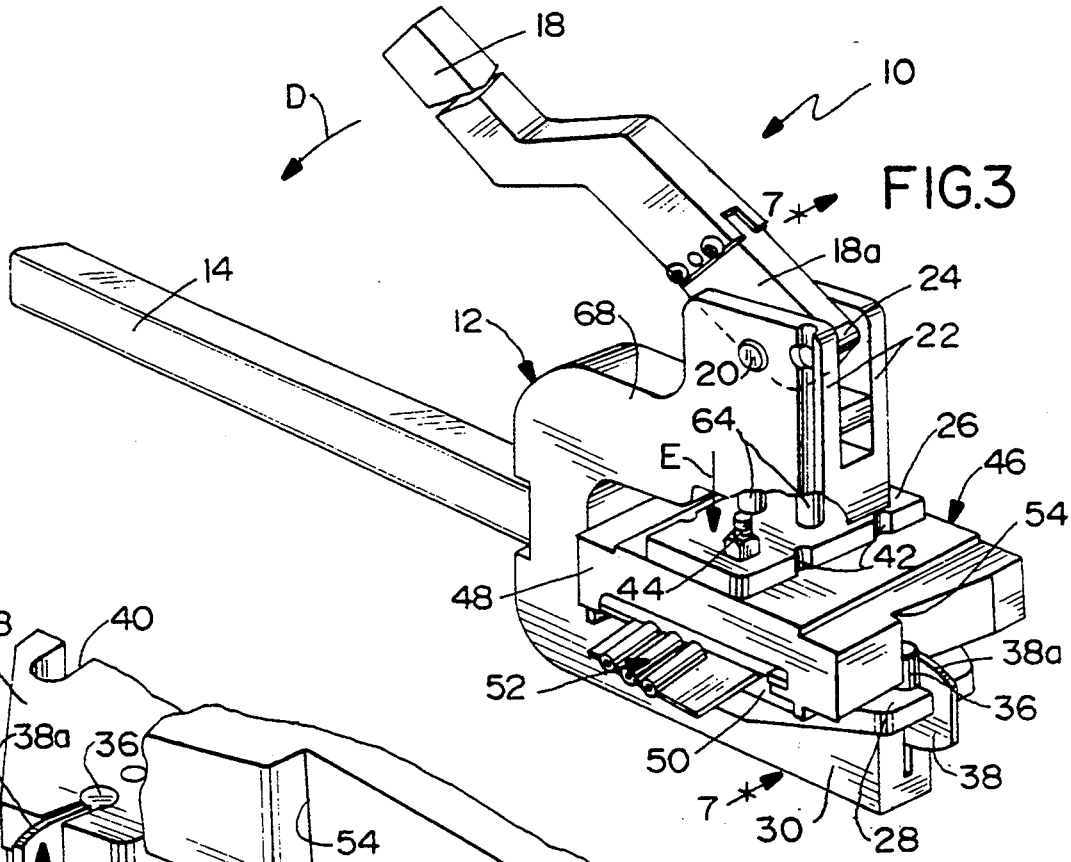
FIG. 3 is a view similar to that of FIG. 1, with a connector positioned within the tool and the press ram handle being partially actuated.

Referring to FIG. 3, an electrical connector, generally designated 46, is shown positioned in tool 10 between press plate 26 and anvil platform 28. The connector is a cable tap assembly including a cable tap housing 48 and a generally flat cable clamp 50. As is known in the art, cable tap housing 48 includes insulation piercing terminals (not shown) for terminating the conductors within a flat or ribbon cable, generally designated 52. Cable clamp 50 is effective to drive the conductors into the insulation piercing portions of the terminals. Cable tap housing 48 further includes a pair of recesses or indentations 54 in opposite sides thereof and into which fixed and yieldable pegs 34 and 36, respectively, project for properly positioning and supporting the connector between press plate 26 and anvil platform 28.

During a terminating operation, with connector 46 positioned in the tool as shown in FIG. 3, pivotal handle 18 is moved downwardly in the direction of arrow "D" toward fixed handle 14. By means described hereinafter, this drives press plate 26 downwardly in the direction of arrow "E" and applies pressure between the press plate and anvil platform 28. Continued movement of handle 18 to a position generally juxtaposed with fixed handle 14 will completely drive cable clamp 50 into cable tap housing 48 and drive the conductors of cable 52 into the insulation displacing terminals within cable tap housing 48.

Figure 4:
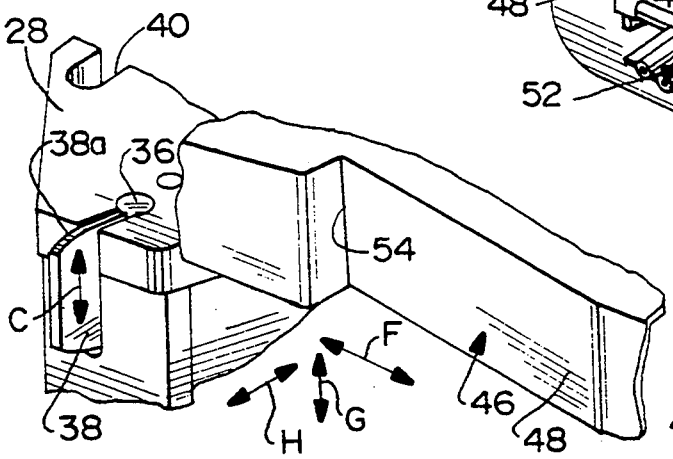
FIG. 4 is an enlarged, fragmented perspective view of the area of the yieldable peg on the anvil means, with the peg in retracted condition.
Figure 5:
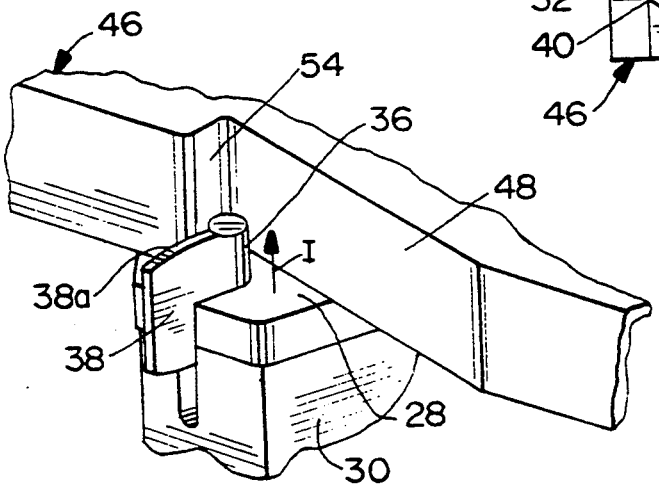
FIG. 5 is a view similar to that of FIG. 4, with the yieldable peg returned to its connector-engaging condition.

Referring to FIGS. 4 and 5, spring-loaded yieldable peg 36 is shown in FIG. 4 in its retracted condition within anvil platform 28 and in FIG. 5 in its projecting condition within recess 54 of cable tap housing 48. In the retracted condition of FIG. 4, the cable tap assembly can be readily positioned within the tool between press plate 26 and anvil platform 28. In the projecting condition of FIG. 5, yieldable peg 36 combines with fixed peg 34 (FIG. 1) to properly position the connector within the tool.

More particularly, FIG. 4 shows a plurality of double-headed arrows "F", "G" and "H" for representing various directions in which a user may attempt to mount cable tap assembly 46 within the tool. Although the user might attempt to insert the connector in the direction of double-headed arrow "F" this is not very likely because of the orientation of handles 14 and 18. Nevertheless, this can be accomplished simply by depressing on cam plate 38 and retracting yieldable peg 36 as shown in FIG. 4. The connector then can be easily positioned in the tool. On the other hand, a user most likely will grasp fixed handle 14 of the tool and move the connector into position with the other hand in the direction of double-headed arrows "G" or "H" or in similar directions more in line with the fixed handle. When this type of action is performed, some part of the connector will engage rounded edge 38*a* of cam plate 38 and drive yieldable peg 36 downwardly to its retracted condition or at least a partially retracted condition. Once the connector is properly positioned as shown in FIG. 5, spring-loaded yieldable peg 36 will automatically return to its projecting, connector-engaging condition in sort of a snapping action and cooperate with fixed peg 34 to maintain the connector properly positioned within the tool.

Although yieldable peg 36, in conjunction with cam plate 38, facilitates easy positioning of a rather cumbersome connector, such as cable tap assembly 46, within tool 10, the yieldable peg also has an advantage of reducing the size of the tool and limiting the stroke of the press plate. More particularly, when the yieldable peg moves to its retracted condition as shown in FIG. 4, the connector can be positioned between generally parallel press plate 26 and anvil platform 28 in a generally horizontal direction, rather than having to angle the connector in order to "drop" the connector between a pair of fixed pegs, for instance. With this ability to allow the connector to horizontally slide into position by retracting the yieldable peg, it can be understood that the working stroke of press plate 26 need not be much more than necessary to force cable clamp 50 into terminating condition with cable tap housing 48 of cable tap assembly 46. By reducing the working stroke of the tool, all kinds of component dimensions of the tool can be reduced and various mechanical advantages can be increased.

Figure 6:
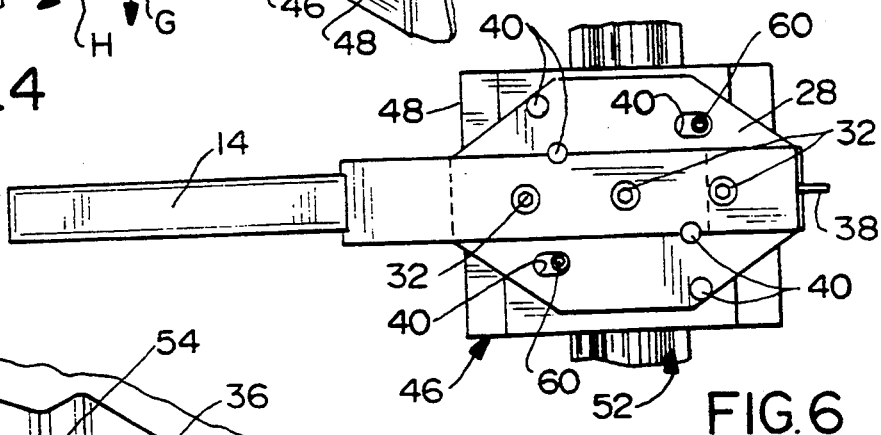
FIG. 6 is a bottom plan view of the tool.

FIG. 6 simply shows a pair of screws or bolts 60 which are visible through a pair of the holes 40 in anvil plate 28. Once cable tap assembly 46 is terminated, these screws or bolts can be tightened through holes 40, and the connector can be removed in a completely assembled condition.

FIGS. 7 and 8 show the press ram assembly or means of tool 10, as indicated generally at 62. The press ram means include a plurality of posts 64 which extend through bores 66 in an arm 68 of U-shaped frame 12. Press plate 26 is secured to the bottom of the posts by appropriate fastening means, such as bolts 70. A top plate 72 is secured to the top of the posts by appropriate fastening means, such as bolts 74. A coil spring 76 is located in a cavity 78 within frame arm 68 and is biased against top plate 72. In essence, the entire press ram means or assembly 62, including posts 64, press plate 26, top plate 72 and bolts 70 and 74 are reciprocally mounted within bores 66 of frame arm 68 for movement in the direction of double-headed arrow "I" (FIG. 7).

FIG. 7 shows press ram assembly 62 in its fully terminating position with handle 18 fully pivoted to its terminating position. In this condition, it can be seen that a flat portion of the handle engages the flat top surface of top plate 72, to define a flat interface 80 therebetween. This flat interengagement creates a "locked-up" condition of the tool. In other words, should handle 18 be released, all of the tool components will remain in the condition as shown in FIG. 7, because the handle and the other components cannot move away from this condition by reactive forces from the connector.

FIG. 7 also shows a coil spring 82 located in a bore 84 in frame arm 30 for spring-loading yieldable peg 36. Therefore, the peg yields against spring 82 to its retracted condition as described above in relation to FIG. 4, and the peg automatically returns to its projecting, connector-engaging condition under the biasing influence of spring 82.

Lastly, FIG. 8 shows pivotal handle 18 moved in the direction of arrow "J" back to a position which allows spring 76 to move press ram assembly 62, including press plate 26, to an upper or loading/unloading position which allows connector 46 to be loaded or unloaded into the tool between press plate 26 and anvil platform 28. By comparing FIG. 7 with FIG. 8, the short working stroke of the tool is readily apparent in comparison to the overall size of cable tap assembly 46 shown in FIG. 3. Yet, yieldable peg 36 allows for a significant overall space for the cable tap assembly to be loaded into and unloaded from the tool.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an applicator tool for applying an electrical connector, having a housing with a bottom and sides and a plurality of insulation piercing terminals, onto a multi-conductor flat cable, said tool including a frame having a press ram drivable through a working stroke toward and away from an anvil means in the form of a generally flat platform for supporting the connector, wherein the improvement comprises connector positioning means on the anvil means including a fixed member and a yieldable member in spaced relationship to position the connector therebetween, the fixed member engaging one side of the connector and the yieldable member moving in a direction perpendicular to said anvil platform when contacted by the housing bottom to a retracted condition to facilitate positioning the connector between the fixed and yieldable members, said press ram having at least a pair of spaced spring loaded pins for engaging and stabilizing the connector.

2. In an applicator tool as set forth in claim 1, wherein said anvil means comprise a generally flat platform and said press ram includes a press plate generally parallel to the platform and including Said spring-loaded pins projecting from the plate toward the platform.

3. An applicator tool for applying an electrical connector, having a housing with a bottom and sides and a plurality of insulation piercing terminals, onto a multi-conductor flat cable, comprising:

a frame having a generally flat anvil platform mounted thereon for supporting the electrical connector;

a press ram movably mounted on the frame and drivable through a working stroke toward and away from the anvil platform, the press ram including a press plate generally parallel to the anvil platform;

a fixed connector-positioning peg projecting from the anvil platform and engaging one side of the connector to properly position the connector on the platform;

a yieldable connector-positioning peg projecting from the anvil platform to yield in a direction perpendicular to said anvil platform when contacted by the housing bottom to a retracted condition to facilitate positioning the connector between the pegs, the yieldable peg having spring means for automatically returning said yieldable peg to a projecting, connector-engaging condition in contact with another edge of said connector when said yieldable peg is no longer in contact with the housing bottom; and at least a pair of spaced spring loaded pins projecting from the press plate for engaging and stabilizing the connector.

4. In a cable terminating press for terminating an electrical connector to a multi-conductor cable, said press including a press ram movable toward an anvil means, wherein the improvement comprises a fixed connector-positioning member on the anvil means for engaging one portion of the connector, a yieldable connector-positioning member on the anvil means spaced from the fixed connector-positioning member for engaging another portion of the connector and positioning the connector between the members, the yieldable member being retractable to facilitate positioning of the connector, and at least a pair of spaced spring loaded pins on the press ram for engaging and stabilizing the connector.

5. In an applicator tool for applying an electrical connector, having a housing with a bottom and sides and a plurality of insulation piercing terminals, onto a multi-conductor flat cable, said tool including a frame having a press ram drivable through a working stroke toward and away from an anvil means in the form of a generally flat platform for supporting the connector, wherein the improvement comprises connector positioning means on the anvil means including a fixed member and a yieldable member in spaced relationship to position the connector therebetween, the fixed member engaging one side of the connector and the yieldable member moving a direction perpendicular to said anvil platform when contacted by the housing bottom to a retracted condition to facilitate positioning the connector between the fixed and yieldable members, said anvil means include at least one aperture to provide access therethrough by a hand tool so that said hand tool engaging the securing means on the connector while the connector remains positioned in the applicator tool.

6. An applicator tool for applying an electrical connector, having a housing with a bottom and sides and a plurality of insulation piercing terminals, onto a multi-conductor flat cable, comprising:

a frame having a generally flat anvil platform mounted thereon for supporting the electrical connector;

a press ram movably mounted on the frame and drivable through a working stroke toward and away from the anvil platform, the press ram including a press plate generally parallel to the anvil platform;

a fixed connector-positioning peg projecting from the anvil platform and engaging one side of the connector to properly position the connector on the platform;

a yieldable connector-positioning peg projecting from the anvil platform to yield in a direction perpendicular to said anvil platform when contacted by the housing bottom to a retracted condition to facilitate positioning the connector between the pegs, the yieldable peg having spring means for automatically returning said yieldable peg to a projecting, connector-engaging condition in contact with another edge of said connector when said yieldable peg is no longer in contact with the housing bottom; and said anvil bottom including at least one aperture to provide access therethrough by a hand tool so that said hand tool engaging securing means on the connector while the connector remains positioned in the applicator tool.

7. An applicator tool for applying an electrical connector having, a housing with a bottom and sides and a plurality of insulation piercing terminals, onto a multi-conductor flat cable, comprising:

a frame having a generally flat anvil platform mounted thereon for supporting the electrical connector;

a press ram movably mounted on the frame and drivable through a working stroke toward and away from the anvil platform, the press ram including a press plate generally parallel to the anvil platform;

a fixed connector-positioning peg projecting from the anvil platform and engaging one side of the connector to properly position the connector on the platform;

a yieldable connector-positioning peg projecting from the anvil platform to yield in a direction perpendicular to said anvil platform when contacted by the housing bottom to a retracted condition to facilitate positioning the connector between the pegs, the yieldable peg having spring means for automatically returning said yieldable peg to a projecting, connector-engaging condition in contact with another edge of said connector when said yieldable peg is no longer in contact with the housing bottom; and said yieldable male peg including an anti-snagging plate projecting radially therefrom beginning near the top thereof.

8. In a cable terminating press for terminating an electrical connector to a multi-conductor cable, said press including a press ram movable toward an anvil means, wherein the improvement comprises a fixed connector-positioning member on the anvil means for engaging one portion of the connector, a yieldable connector-positioning member on the anvil means spaced from the fixed connector-positioning member for engaging another portion of the connector and positioning the connector between the members, the yieldable member being retractable to facilitate positioning of the connector, and at least one aperture in said anvil means to provide access therethrough by a hand tool so that said hand tool engaging securing means on the connector while the connector remains positioned in the cable terminating press.

* * * * *